US012000245B2

(12) United States Patent
Zhang et al.

(10) Patent No.: US 12,000,245 B2
(45) Date of Patent: Jun. 4, 2024

(54) APPARATUS FOR PREVENTING AND CONTROLLING SECONDARY GENERATION OF HYDRATES IN WELLBORE DURING DEPRESSURIZATION EXPLOITATION OF OFFSHORE NATURAL GAS HYDRATES AND PREVENTION AND CONTROL METHOD

(71) Applicant: CHINA UNIVERSITY OF PETROLEUM (EAST CHINA), Qingdao (CN)

(72) Inventors: Jianbo Zhang, Qingdao (CN); Zhiyuan Wang, Qingdao (CN); Xiaohui Sun, Qingdao (CN); Baojiang Sun, Qingdao (CN); Hui Liu, Qingdao (CN); Shikun Tong, Qingdao (CN); Qingwen Kong, Qingdao (CN); Peng Liu, Qingdao (CN)

(73) Assignee: CHINA UNIVERSITY OF PETROLEUM (EAST CHINA), Qingdao (CN)

( * ) Notice: Subject to any disclaimer, the term of this patent is extended or adjusted under 35 U.S.C. 154(b) by 0 days.

(21) Appl. No.: 18/341,813

(22) Filed: Jun. 27, 2023

(65) Prior Publication Data

US 2024/0084675 A1 Mar. 14, 2024

(30) Foreign Application Priority Data

Sep. 14, 2022 (CN) ..... 202211119809.7

(51) Int. Cl.
*E21B 43/01* (2006.01)
*E21B 41/00* (2006.01)

(52) U.S. Cl.
CPC ..... *E21B 41/0099* (2020.05)

(58) Field of Classification Search
CPC .... E21B 34/063; E21B 41/0078; E21B 43/12; E21B 43/00; E21B 47/07; E21B 47/06;
(Continued)

(56) References Cited

U.S. PATENT DOCUMENTS 3,566,970 A * 3/1971 Crow ..... E21B 43/00 166/310
4,625,803 A * 12/1986 Walhaug ..... E21B 33/122 166/371

(Continued)

FOREIGN PATENT DOCUMENTS

CN 106194165 A 12/2016
CN 106322121 A 1/2017

(Continued)

*Primary Examiner* — Edwin J Toledo-Duran
(74) *Attorney, Agent, or Firm* — CBM PATENT CONSULTING, LLC

(57) ABSTRACT

An apparatus for preventing and controlling secondary generation of hydrates in a wellbore during depressurization exploitation of offshore natural gas hydrates includes a gas recovery pipe column, a water recovery pipe column, a gas-liquid mixed transportation pipe section, a data collecting and processing unit, and a reaction control apparatus; according to characteristics of different exploitation pipe columns, three injection pipelines and three monitoring points are arranged to predict dynamic changes in a secondary generation risk of the hydrates throughout the wellbore; measures for preventing and controlling the secondary generation of the hydrates are taken at different pipe column positions by the integrated utilization of inhibitor injection, heating for pipe columns, the additional arrangement of electric submersible pumps, and other methods.

8 Claims, 2 Drawing Sheets

(58) Field of Classification Search
CPC ..... E21B 37/06; E21B 41/00; E21B 43/01; E21B 43/02; E21B 36/04; E21B 37/00; E21B 43/38; E21B 49/00; E21B 41/0099; C10G 33/08; G05D 7/0617; G05B 15/02; G01F 1/00; F17D 3/06; F17D 3/03; F17D 3/12; F17D 3/01; F17D 5/00; F17D 5/02; F17D 1/07
See application file for complete search history.

(56) References Cited

U.S. PATENT DOCUMENTS 4,988,389 A * 1/1991 Adamache ..... E21B 43/40 166/61
5,076,364 A * 12/1991 Hale ..... E21B 43/00 166/371
5,224,543 A * 7/1993 Watkins ..... C09K 8/528 507/224
5,351,756 A * 10/1994 Minkkinen ..... E21B 41/02 166/267
5,447,201 A * 9/1995 Mohn ..... E21B 17/003 166/65.1
5,893,416 A * 4/1999 Read ..... E21B 43/088 166/228
5,937,894 A * 8/1999 Rojey ..... F17D 3/14 137/485
6,028,233 A * 2/2000 Colle ..... C08F 226/02 166/371
6,148,913 A * 11/2000 Collins ..... C09K 8/528 166/263
7,152,681 B2 * 12/2006 Olsen ..... E21B 43/121 166/368
9,002,650 B2 * 4/2015 Lievois ..... G01F 1/74 250/269.1
10,047,303 B2 * 8/2018 Rustad ..... E21B 43/00
10,315,867 B2 * 6/2019 Nguyen ..... E21B 43/267
11,274,049 B2 * 3/2022 Salu ..... C10G 75/02
11,585,206 B2 * 2/2023 Ansari ..... E21B 47/06
11,795,807 B2 * 10/2023 Frankland ..... E21B 33/076
2003/0011386 A1 * 1/2003 Xie ..... G01N 27/06 324/694
2003/0145991 A1 * 8/2003 Olsen ..... E21B 43/13 166/265
2003/0155123 A1 * 8/2003 Wat ..... C09K 8/502 166/305.1
2004/0043501 A1 * 3/2004 Means ..... E21B 49/006 436/164
2004/0134662 A1 * 7/2004 Chitwood ..... E21B 33/126 166/369
2004/0168811 A1 * 9/2004 Shaw ..... E21B 41/02 166/368
2005/0139356 A1 * 6/2005 Prukop ..... E21B 37/06 166/300
2006/0165344 A1 * 7/2006 Mendez ..... G01L 11/025 385/13
2007/0045268 A1 * 3/2007 Vinegar ..... E21B 36/04 219/207
2007/0095537 A1 * 5/2007 Vinegar ..... E21B 43/24 166/302
2007/0163780 A1 * 7/2007 Onodera ..... G01F 23/22 166/371
2007/0284108 A1 * 12/2007 Roes ..... B32B 15/013 166/302
2007/0289740 A1 * 12/2007 Thigpen ..... E21B 37/06 166/250.01
2008/0257544 A1 * 10/2008 Thigpen ..... E21B 43/14 166/250.01
2008/0262735 A1 * 10/2008 Thigpen ..... E21B 47/10 702/6
2008/0262736 A1 * 10/2008 Thigpen ..... E21B 43/128 702/9
2008/0262737 A1 * 10/2008 Thigpen ..... G01V 1/40 702/9
2008/0314593 A1 * 12/2008 Vinegar ..... E21B 43/24 166/302
2009/0032303 A1 * 2/2009 Johnson ..... E21B 47/13 175/40
2009/0034368 A1 * 2/2009 Johnson ..... E21B 47/14 367/83
2009/0050326 A1 * 2/2009 Grynning ..... B08B 9/00 166/312
2009/0071652 A1 * 3/2009 Vinegar ..... E21B 43/2401 166/303
2009/0103984 A1 * 4/2009 Zarisfi ..... F16L 1/201 137/236.1
2009/0294123 A1 * 12/2009 Mescall ..... E21B 34/063 166/205
2010/0018712 A1 * 1/2010 Tian ..... E21B 37/06 166/310
2010/0048963 A1 * 2/2010 Jones ..... E21B 43/14 422/187
2012/0097362 A1 * 4/2012 Kanstad ..... F28G 15/003 165/45
2012/0181041 A1 * 7/2012 Willman ..... E02F 3/925 166/357
2012/0261191 A1 * 10/2012 Klomp ..... E21B 25/18 175/50
2012/0273216 A1 * 11/2012 Beynet ..... E21B 37/06 166/345
2012/0318502 A1 * 12/2012 Lievois ..... G01F 1/74 250/269.1
2013/0092371 A1 * 4/2013 Hartog ..... E21B 47/06 166/250.01
2013/0319102 A1 * 12/2013 Ringgenberg ..... E21B 49/008 73/152.28
2014/0209465 A1 * 7/2014 Whitney ..... C10G 33/06 204/554
2015/0184490 A1 * 7/2015 Kanstad ..... E21B 41/0007 166/335
2015/0368544 A1 * 12/2015 Angman ..... C02F 1/68 210/698
2016/0109874 A1 * 4/2016 Holmes ..... E21B 33/0355 700/275
2016/0115395 A1 * 4/2016 Rustad ..... G05D 7/0617 700/282
2016/0333669 A1 * 11/2016 Mello ..... E21B 43/267
2017/0066958 A1 * 3/2017 Padilla-Acevedo ... C09K 8/528
2017/0089187 A1 * 3/2017 Hytken ..... E21B 43/24
2017/0115143 A1 * 4/2017 Farkas ..... E21B 37/06
2017/0122046 A1 * 5/2017 Vavik ..... E21B 47/10
2017/0138170 A1 * 5/2017 Vavik ..... G01V 20/00
2017/0145788 A1 * 5/2017 Fouchard ..... E21B 41/00
2017/0158976 A1 * 6/2017 O'Rear ..... E21B 43/34
2017/0198195 A1 * 7/2017 Beuterbaugh ..... C09K 8/62
2017/0335833 A1 * 11/2017 Kanstad ..... F04B 15/00
2017/0350213 A1 * 12/2017 Vavik ..... E21B 34/08
2018/0072599 A1 * 3/2018 Padilla-Acevedo .... C08L 41/00
2018/0073320 A1 * 3/2018 Holmes ..... E21B 34/16
2018/0298748 A1 * 10/2018 Rustad ..... E21B 47/10
2018/0327294 A1 * 11/2018 Mantri ..... C02F 5/12
2018/0328541 A1 * 11/2018 Lachance ..... C09K 8/52
2018/0340115 A1 * 11/2018 Fouchard ..... C09K 8/524
2018/0363422 A1 * 12/2018 Roberts, IV ..... E21B 47/10
2019/0062213 A1 * 2/2019 Lewis ..... C04B 24/36
2019/0360314 A1 * 11/2019 Liu ..... E21B 43/35
2020/0263076 A1 * 8/2020 Padilla-Acevedo .... E21B 37/06
2021/0062620 A1 * 3/2021 Yan ..... E21B 43/088
2021/0108488 A1 * 4/2021 Hidaka ..... E21B 37/06
2021/0115323 A1 * 4/2021 Shumway ..... C09K 8/32
2021/0222552 A1 * 7/2021 Gao ..... E21B 43/00
2021/0269344 A1 * 9/2021 Al-Harbi ..... E21B 37/06
2021/0348482 A1 * 11/2021 Sugimoto ..... E21B 43/088
2021/0403794 A1 * 12/2021 Vo ..... C10L 3/107
2022/0010654 A1 * 1/2022 Aljeaban ..... E21B 47/00
2022/0098970 A1 * 3/2022 Deshmukh ..... G01N 33/2823
2022/0154889 A1 * 5/2022 Otto ..... F17D 3/12
2022/0298892 A1 * 9/2022 Li ..... E21B 43/35
2022/0341312 A1 * 10/2022 Frankland ..... E21B 33/035

(56) References Cited

U.S. PATENT DOCUMENTS

| | | | | |
|---|---|---|---|---|
| 2023/0235646 | A1* | 7/2023 | Wang | C09K 8/528<br>166/304 |

FOREIGN PATENT DOCUMENTS

| | | | |
|---|---|---|---|
| CN | 106869871 | A | 6/2017 |
| CN | 106869902 | A | 6/2017 |
| CN | 111076094 | A | 4/2020 |
| CN | 113216902 | A | 8/2021 |
| WO | 2017089846 | A1 | 6/2017 |

* cited by examiner

APPARATUS FOR PREVENTING AND CONTROLLING SECONDARY GENERATION OF HYDRATES IN WELLBORE DURING DEPRESSURIZATION EXPLOITATION OF OFFSHORE NATURAL GAS HYDRATES AND PREVENTION AND CONTROL METHOD

CROSS-REFERENCE TO RELATED APPLICATIONS

This application claims priority to Chinese Patent Application Ser. CN2022111198097 filed 14 Sep. 2022.

FIELD OF THE INVENTION

The present disclosure relates to an apparatus for preventing and controlling secondary generation of hydrates in a wellbore during depressurization exploitation of offshore natural gas hydrates and a prevention and control method.

BACKGROUND OF THE INVENTION

Natural gas hydrates are ice-like cage compounds that are formed when water molecules and hydrocarbon gas molecules are combined at certain low-temperature and high-pressure conditions, which serve as new clean and efficient energy with huge reserves. According to incomplete statistics, organic carbon reserves in the natural gas hydrates are twice as large as the total reserves of fossil energy, such as oil gases, around the world. The natural gas hydrates are typically present in submarine sediments of the deep sea which is more than 300 m in depth, terrestrial permafrost regions, and other low-temperature and high-pressure regions. Vast deep sea regions are ideal environments for the stable existence of the natural gas hydrates, which contain more than 95% of the total reserve of natural gas hydrates, and thus, it is an important direction for energy development in the future.

In the existing exploitation methods (depressurization method, heat injection method, chemical agent injection method, $CO_2$ displacement method, solid fluidization method, and the like) of the natural gas hydrates, the depressurization method has the advantages of high gas recovery rate, easiness in operation, low costs, and the like, which is deemed as a preferred method for most possibly achieving the commercial exploitation of the natural gas hydrates in the future. During the depressurization exploitation of offshore natural gas hydrates, as seawater temperature will drop with an increase in the water depth (temperature may be as low as 2 to 4° C. at 1500 m beneath the seawater), temperature and pressure conditions for the secondary generation of the hydrates are easily satisfied in exploitation wellbores, which will pose the serious secondary generation risk of hydrates. Once the secondary generation risk of the hydrates is found in the exploitation wellbores, part of generated hydrates will be deposited onto pipe walls to form hydrate deposition layers, resulting in shrinking fluid flow channels, and even obstructing flow in severe cases, which, in turn, causes the safety problems of the flow. In 2017, during the pilot depressurization exploitation of offshore natural gas hydrates, carried out for the second time in Japan, the pilot exploitation process was interrupted twice due to the secondary hydrate generation and obstruction problems in exploitation pipe columns, and the hydrates were removed from the obstructed pipe columns for 31.25 h and 13.5 h, respectively, which severely affected the pilot exploitation schedule. Not only will the secondary generation of the hydrates in the exploitation wellbores of the offshore natural gas hydrates affect the pilot exploitation schedule, but it may affect the subsequent continuous depressurization. The fact that the bottom hole pressure in the pilot exploitation process for the second time in Japan was not reduced to the expected value may also be associated with the secondary generation, and in severe cases, safety accidents of pilot exploitation may even be caused. Currently, the injection of excessive thermodynamic inhibitors, as a major means of preventing and controlling the flow obstacle of the hydrates in deep water wellbores, is used to completely prevent hydrate generation throughout the wellbores. However, the method has defects of large using amounts (10% to 60%) of inhibitors, large storage area, high costs, and high requirements on injection equipment, and especially, the defects become more prominent when the water yield is high, and even the problems that the inhibitors cannot be injected and the like may be encountered, resulting in the failure in the prevention and control scheme for the secondary generation of the hydrates.

In conclusion, a method for preventing and controlling secondary generation of hydrates in depressurization exploitation of offshore natural gas hydrates economically and efficiently has not been found yet. This is a key difficulty that restricts the safe and efficient exploitation of offshore natural gas hydrates. Therefore, the present disclosure is proposed.

SUMMARY OF THE INVENTION

Aiming at defects in the prior art, and especially for problems of large consumption of an inhibitor and poor prevention and control effects of the existing method for preventing and controlling secondary generation of natural gas hydrates, the present disclosure provides an apparatus for preventing and controlling secondary generation of hydrates during depressurization exploitation of offshore natural gas hydrates. Based on the characteristics of different exploitation pipe columns, a combination of inhibitor injection, pipe column heating, the additional arrangement of an electric submersible pump, and other means has been developed to prevent and control the secondary generation of the hydrates during depressurization exploitation of offshore natural gas hydrates. This approach effectively improves the efficacy and economic benefits of the prevention and control of the secondary generation of the hydrates during depressurization exploitation of the offshore natural gas hydrates, providing a guarantee for achieving the flowing safety of offshore natural gas hydrates in the depressurization exploitation process.

A technical solution of the present disclosure is as follows:

The apparatus for preventing and controlling the secondary generation of the hydrates in a depressurization exploitation wellbore of offshore natural gas hydrates includes a gas recovery pipe column, a water recovery pipe column, a gas-liquid mixed transportation pipe section, a data collecting and processing unit, and a reaction control apparatus, and tail ends of the gas recovery pipe column and the water recovery pipe column are connected with a top of the gas-liquid mixed transportation pipe section; the gas-liquid mixed transportation pipe section is positioned in hydrate reservoirs; and the gas recovery pipe column and the water recovery pipe column recover gases and water decomposed by the natural gas hydrates in the reservoirs respectively;

the data collecting and processing unit includes a first data monitoring point, a second data monitoring point, a third data monitoring point, and a computer terminal; the first data monitoring point is positioned on a top of the gas recovery pipe column, and collects a temperature, pressure and gas flow of the top of the gas recovery pipe column; the second data monitoring point is positioned on a top of the water recovery pipe column, and collects a temperature, pressure and gas flow of the top of the water recovery pipe column; the third data monitoring point is positioned on a tail end of the gas-liquid mixed transportation pipe section, and collects a temperature and pressure of a well bottom; and the computer terminal receives and processes temperature, pressure, and flow data collected from the first data monitoring point, the second data monitoring point, and the third data monitoring point; and the reaction control apparatus includes a signal actuator, a hydrate inhibitor storage tank, a hydrate inhibitor injection pump, a first inhibitor injection point, a second inhibitor injection point, a third inhibitor injection point, a first electric submersible pump, a second electric submersible pump, and a heater; one end of the signal actuator is connected with the computer terminal, and the other end of the signal actuator is connected with the hydrate inhibitor injection pump; the hydrate inhibitor injection pump is respectively connected with the first inhibitor injection point, the second inhibitor injection point, and the third inhibitor injection point via injection pipelines, and a control valve is arranged on each of the injection pipelines; the first inhibitor injection point is positioned on the top of the gas recovery pipe column, the second inhibitor injection point is positioned at a bottom of the gas recovery pipe column, and the third inhibitor injection point is positioned on the tail end of the gas-liquid mixed transportation pipe section; the first electric submersible pump is positioned at a bottom of the water recovery pipe column, and the second electric submersible pump is positioned in the middle of the water recovery pipe column; and the heater is positioned at the bottom of the gas recovery pipe column.

Preferably, a joint of the water recovery pipe column and the gas-liquid mixed transportation pipe section and a joint of the gas recovery pipe column and the gas-liquid mixed transportation pipe section are provided with a casing pipe, the first electric submersible pump is positioned in the casing pipe, and a blowout preventer is arranged on a tail end of the gas recovery pipe column.

Preferably, a water storage pipe section is arranged in the middle of the water recovery pipe column, the middle of the water recovery pipe column is divided into a first half and a second half of the water recovery pipe column, a tail end of the first half of the water recovery pipe column and a top of the second half of the water recovery pipe column are positioned in the water storage pipe section, and the second electric submersible pump is positioned on the tail end of the first half of the water recovery pipe column.

A prevention and control method of the apparatus for preventing and controlling secondary generation of hydrates in wellbore during depressurization exploitation of offshore natural gas hydrates includes the following steps:

The three data collection points are installed on the top of the gas recovery pipe column, the top of the water recovery pipe column, and the tail end of the gas-liquid mixed transportation pipe section, which collect temperature, pressure and flow data at different positions; the different data collection points are connected with the computer terminal, and the collected data is transmitted to the computer terminal in real time; the computer terminal performs analysis and processing on the data collected from the different data collection points, sends instructions to the signal actuator to control inhibitor injection rates of different hydrate inhibitor injection points, and to control power of the heater in the gas recovery pipe column and power of the different electric submersible pumps in the water recovery pipe column to prevent and control the secondary generation of the hydrates in the gas recovery pipe column and the water recovery pipe column.

According to the present disclosure, preferably, the prevention and control method of the apparatus for preventing and controlling secondary generation of hydrates in a wellbore during depressurization exploitation of offshore natural gas hydrates includes the following steps:

(1) Real-Time Monitoring of Data at Different Positions temperature, pressure and flow data is monitored at different positions via the first data monitoring point on the top of the gas recovery pipe column, the second data monitoring point on the top of the water recovery pipe column, and the third data monitoring point on the tail end of the gas-liquid mixed transportation pipe section, and the collected data is transmitted to the computer terminal in real time;

(2) Analysis of a Secondary Generation Risk of Hydrates Throughout Wellbore the temperature and pressure distributions throughout the wellbore are obtained by the computer terminal via calculation according to the received temperature, pressure and flow data at different positions; the computer terminal judges whether the secondary generation of the hydrates happens at different positions in combination with the phase equilibrium calculation result of the natural gas hydrates, and the secondary generation risk of the hydrates throughout the wellbore is analyzed based on the judgment result, which provides a foundation for the prevention and control of the secondary generation of the hydrates in different pipe columns;

(3) Prevention and Control Reaction of Secondary Generation of Hydrates in Different Pipe Columns according to the secondary generation risk of the hydrates in different pipe columns obtained by calculation, the computer terminal sends prevention and control instructions for the secondary generation of the hydrates, and corresponding measures of preventing and controlling the secondary generation of the hydrates are taken for different pipe columns; inhibitor injection is used as the measure for preventing and controlling the secondary generation of the hydrates at the gas-liquid mixed transportation pipe section, the collaborative prevention and control of the inhibitor injection+the heating of the pipe column bottom is used as the prevention and control measure for the secondary generation of hydrates in the gas recovery pipe column, and the collaborative prevention and control of depressurization by double pumps+inhibitor is used as at the prevention and control measure for secondary generation of the hydrates in the water recovery pipe column. These approaches may ensure multiphase flow safety in the exploitation wellbore for offshore natural gas hydrates.

According to the present disclosure, preferably, in step (2), as a significant temperature gradient exists in a stratum/seawater outside the exploitation wellbore for the offshore natural gas hydrates, a temperature difference exists between the fluid in the pipe columns and external environment. Furthermore, given differences in structures of pipe columns at different positions, distinct heat transfer processes are formed between the fluid flow in the exploitation wellbore and the external environment: ① well section below mud line-gas-liquid mixed transportation pipe section: heat transfer between the fluid in the gas-liquid mixed transportation pipe section and the external stratum; ② well section above mud line-gas recovery pipe column: heat transfer between the fluid in the gas recovery pipe column and external seawater; ③ well section above mud line-water recovery pipe column: heat transfer between the fluid in the water recovery pipe column and the external seawater; the mud line is a seabed (i.e., a boundary of the seawater and a shallow layer of the seabed); and according to the characteristic of pipe columns for depressurization exploitation of offshore natural gas hydrates and in consideration of the influence of hydrate phase changes on temperature changes, the temperature distribution of the exploitation wellbore is calculated by the following formula based on the principle of conservation of energy:

$$\frac{\partial}{\partial t}\left[A_{te}\rho_m\left(C_{pm}T_f + v_m^2/2\right)\right] + \frac{\partial}{\partial s}\left[A_{te}\rho_m v_m\left(H + v_m^2/2\right)\right] = -A_{te}\rho_m v_m g\sin\theta + \frac{(R_{hf} - R_{hi})\Delta H}{M_h} + Q_{st} \quad (1)$$

where, $C_{pm}$ is a specific heat of a mixed fluid at constant pressure, J/(kg·° C.); $T_f$ is a fluid temperature, ° C.; H is a specific enthalpy of the mixed fluid, J/kg; ΔH is a molar enthalpy of formation of the hydrates, J/mol; $M_h$ is a molar molecular mass of the hydrates, kg/mol; $\rho_m$ is a density of the mixed fluid, kg/m$^3$; $v_m$ is a flow velocity of the mixed fluid, m/s; $Q_{st}$ indicates a heat exchange rate between the fluid in the pipe columns and ambient environment, J/(m·s); s is a position, m; $A_{te}$ is a net sectional area of the pipe column, m$^2$; $R_{hf}$ is a generation rate of the hydrates, kg/(m·s); $R_{hi}$ is a decomposition rate of the hydrates, kg/(m·s); and θ is an angle of inclination, °.

Due to the differences in structures of the exploitation pipe column at different well depths, the calculation of $Q_{st}$ will vary with different well depth positions;

Well Section Above Mud Line-Gas Recovery Pipe Column:

$$Q_{st} = \frac{2r_{tgo}U_{tgo}}{v_m r_{tgi}^2}\cdot(T_{sea} - T_f)\ H_d \le H_{sea} \quad (2)$$

Well Section Above Mud Line-Water Recovery Pipe Column:

$$Q_{st} = \frac{2r_{two}U_{two}}{v_m r_{twi}^2}\cdot(T_{sea} - T_f)\ H_d \le H_{sea} \quad (3)$$

Well Section Below Mud Line-Gas-Liquid Mixed Transportation Pipe Section:

$$Q_{st} = \frac{2}{v_m r_{ti}^2}\cdot\frac{r_{to}U_{to}k_e}{k_e + T_D r_{to}U_{to}}\cdot(T_{ei} - T_f)\ H_d > H_{sea} \quad (4)$$

where, $r_{tgo}$, $r_{two}$, and $r_{to}$ are outer diameters of the gas recovery pipe column, the water recovery pipe column, and the gas-liquid mixed transportation pipe section, respectively, m; $T_{sea}$ is a seawater temperature, ° C.; $U_{tgo}$, $U_{two}$, and $U_{to}$ are overall coefficients of heat transfer based on outer surfaces of the gas recovery pipe column, the water recovery pipe column, and the gas-liquid mixed transportation pipe section as reference surfaces, respectively, W/(m$^2$·K); $H_d$ is a well depth, m; $H_{sea}$ is a water depth, m; $T_{ei}$ is an environment temperature, ° C.; $r_{tgi}$, $r_{twi}$, and $r_{ti}$ are inner diameters of the gas recovery pipe column, the water recovery pipe column, and the gas-liquid mixed transportation pipe section, respectively, m; $k_e$ is a stratum heat conductivity coefficient, W/(m·K); and $T_D$ is a dimensionless temperature.

According to the present disclosure, preferably, in step (2), the fluid in the hydrate exploitation pipe column is primarily affected by forces of gravity, pressure difference, and frictional resistance during the flowing process. According to the principle of conservation of momentum and in consideration of factors, such as changes in gas volume fraction and changes in gas-water volume fraction distribution arising from gas expansion, a calculation formula of pressure field distribution in the pilot exploitation pipe column of the hydrates is as follows:

$$\frac{\partial}{\partial t}(A_{te}\rho_m v_m) + \frac{\partial}{\partial s}\left(A_{te}\rho_m v_m^2\right) + \frac{d(A_{te}P_f)}{ds} + A_{te}g\rho_m\cos\alpha + \frac{d(A_{te}Fr)}{ds} = 0 \quad (5)$$

where, $P_f$ is a fluid pressure in the pilot exploitation pipe column, Pa; α is an angle of inclination, rad; and Fr is a frictional pressure drop, Pa.

According to the present disclosure, preferably, in step (2), phase equilibrium temperature and pressure conditions of the natural gas hydrates are calculated by the following formula:

$$P_e = 10^6\exp\left(\sum_{n=0}^{5} a_n(T_f + \Delta T_d)^n\right) \quad (6)$$

$$\text{where, } \begin{cases} a_0 = -1.94138504464560\times10^5 \\ a_1 = 3.31018213397926\times10^3 \\ a_2 = -2.25540264493806\times10^1 \\ a_3 = 7.67559117787059\times10^{-2} \\ a_4 = -1.30465829788791\times10^{-4} \\ a_5 = 8.86065316687571\times10^{-8} \end{cases} \quad (7)$$

where, $\Delta T_d$ is a temperature at which a decline in a hydrate equilibrium is caused by a hydrate inhibitor, K, which may be calculated by the following formula:

$$\Delta T_d = \Delta T_{d,r}\frac{\ln(1-x)}{\ln(1-x_r)} \quad (8)$$

where, $P_e$ is a phase equilibrium pressure of hydrates, Pa; x is a molar fraction of the hydrate inhibitor in a water phase, which is dimensionless; $x_r$ is a reference molar fraction of the hydrate inhibitor in the water phase, which is dimensionless; and $\Delta T_{d,r}$ is a temperature at which the decline in the hydrate equilibrium is caused under the molar fraction of the inhibitor as $x_r$, K.

Preferably, in step (2), the secondary generation risk of the hydrates in different pipe columns is determined by comparing the temperature of the pipe columns with the phase equilibrium temperature of the natural gas hydrates; a natural gas hydrate phase equilibrium temperature-pressure curve under the condition of the produced fluid component is converted into a temperature-depth curve by taking into account a temperature and pressure distribution curve of the wellbore and a hydrate phase equilibrium curve, for which coordinate conversion is performed; and when the temperature on the wellbore temperature curve at a certain depth is lower than that on the hydrate phase equilibrium curve, the fluid temperature in the wellbore at the depth satisfies the secondary generation condition of the hydrates, that is, there is the secondary generation risk of the hydrates. A discriminant formula of the secondary generation of the hydrates is as follows:

$$P_e > P_f \text{ or } T_e < T_f \quad (9)$$

where, Te is a phase equilibrium temperature of the hydrates, ° C.

Preferably, in step (3), different prevention and control measures of the secondary generation of the hydrates are taken for different pipe columns in the wellbore; at the gas-liquid mixed transportation pipe section, when the processing result from the computer terminal indicates that the secondary generation risk of the hydrates is found in a horizontal pipe section of the gas-liquid mixed transportation pipe section at the well bottom, the concentration of the hydrate inhibitor as required for preventing and controlling the secondary generation of the hydrates is obtained via calculation according to the prevention and control requirement for the secondary generation of the hydrates, which may be determined according to formulas (6), (7) and (8); the higher the concentration of the hydrate inhibitor, the higher the temperature and the lower the pressure at which the hydrate phase equilibrium is achieved are perceived to be; the concentration of the inhibitor is designed to make the phase equilibrium temperature of the hydrates higher than a fluid temperature or make the phase equilibrium pressure thereof lower than a fluid pressure, thereby avoiding the secondary generation of the hydrates in the wellbore; as an injection rate is associated with the concentration, the inhibitor injection rate is obtained by multiplying the amount of recovered water by the concentration; and then, the inhibitor injection instructions are sent to the third inhibitor injection point on the tail end of the horizontal pipe section, and the control valve on the injection pipeline is opened, thereby effectively preventing and controlling the secondary generation of the hydrates in the gas-liquid mixed transportation pipe section;

for the water recovery pipe column, when the processing result from the computer terminal indicates that there is the secondary generation risk of the hydrates in the water recovery pipe column, it is required to take into account the concentration of the hydrate inhibitor which has possibly been present in an aqueous solution, and the concentration of the hydrate inhibitor in the water recovery pipe column is the same as that of the hydrate inhibitor at the gas-liquid mixed transportation pipe section; water in the water recovery pipe column is pumped from the gas-liquid mixed transportation pipe section; if the hydrate inhibitor is not injected into the third inhibitor injection point, the concentration of the existing hydrate inhibitor in the water recovery pipe column is 0; if the hydrate inhibitor is injected into the third inhibitor injection point, the concentration of the existing hydrate inhibitor in the water recovery pipe column is the concentration of the hydrate inhibitor at the gas-liquid mixed transportation pipe section; if the hydrate inhibitor is not injected into the third inhibitor injection point, the computer terminal controls, based on the processing result, the operating power of the first electric submersible pump and the operating power of the second electric submersible pump on the water recovery pipe column to reduce the pressure throughout the water recovery pipe column until the pressure in the pipe column drops to below the phase equilibrium pressure of the hydrates, thereby preventing and controlling the secondary generation of the hydrates therein. Meanwhile, the output power of the first electric submersible pump and the output power of the second electric submersible pump are maintained at a consistent level, which ensures that the liquid level in the second electric submersible pump module stays above the second electric submersible pump to ensure the safety of the fluid flow in the water recovery pipe column; if it is unable to make the pressure of the water recovery pipe column drop to below the phase equilibrium pressure of the hydrates, the hydrate inhibitor needs to be injected into the third inhibitor injection point, and if the hydrate inhibitor has been injected into the third inhibitor injection point, the concentration of the inhibitor in the water recovery pipe column is the same as that of the inhibitor at the gas-liquid mixed transportation pipe section, based on which the operating power of the first electric submersible pump and the operating power of the second electric submersible pump on the water recovery pipe column are controlled to reduce the pressure throughout the water recovery pipe column, making the pressure in the pipe column drop to below the phase equilibrium pressure of the hydrates; meanwhile, the output power of the first electric submersible pump and the output power of the second electric submersible pump are maintained at a consistent level, so that the liquid level in the second electric submersible pump module is stably maintained above the second electric submersible pump; and if it is unable to meet the prevention and control requirement of the hydrates by the depressurization of the electric submersible pumps and the existing inhibitor concentration, a certain concentration of hydrate inhibitor continues to be injected into the third inhibitor injection point to avoid the generation of the hydrate; and for the gas recovery pipe column, when the processing result from the computer terminal indicates that there is the secondary generation risk of the hydrates in the gas recovery pipe column, the computer terminal sends the heating instructions to the heater at the bottom of the gas recovery pipe column to elevate gas temperature in the gas recovery pipe column. After heating, the concentration of the hydrate inhibitor required for preventing and controlling the secondary generation of the hydrates is calculated according to the prevention and control requirement for the secondary generation of the hydrates, and the secondary generation of the hydrates is determined according to formulas (6), (7) and (8); the inhibitor injection instructions are then sent to the first inhibitor injection point and the second inhibitor injection point, and the control valve on the injection pipeline is opened; the injection flow rate of the first inhibitor injection point is independent of that of the second inhibitor injection point, the latter is used specifically to prevent the secondary generation of the hydrates in the gas recovery pipe column. The former, however, is used to stabilize the concentration of the inhibitor and avoid the generation risk of the hydrates arising from throttling and temperature drops of the produced fluid that flows into the platform pipeline; and a heating temperature is encouraged to be at the highest level possible, but an ideal state of being above the phase equilibrium temperature of the hydrates after heating is impossible to achieve for the heating apparatus on site. As such, the secondary generation risk of the hydrates is prevented in the gas recovery pipe column by combining heating and inhibitor injection, that is, heating is performed, and then, the concentration of the injected inhibitor and the injection rate are determined based on the temperature after heating, thereby achieving the prevention and control of the secondary generation risk of the hydrates in the gas recovery pipe column.

All aspects not fully described in the present disclosure shall be referenced to the prior art.

The present disclosure has beneficial effects that

1. According to the present disclosure, dynamic changes in the secondary generation risk of the hydrates throughout the wellbore can be predicted in real time based on the temperature, pressure, and flow data monitored at the different positions on site in real time in combination of a wellbore temperature field calculation model and a natural gas hydrate phase equilibrium prediction model. By this method, the possible specific positions of the secondary generation of the hydrates in different pipe columns can be determined, enabling the accurate positioning of the secondary generation of the hydrates to facilitate more accurate monitoring. This method lays a foundation for the efficient prevention and control of the secondary generation risk of the hydrates in different pipe columns.
2. According to the present disclosure, the exploitation of the offshore natural gas hydrates is divided into two categories: the gas recovery pipe column and the water recovery pipe column. Furthermore, distinct measures will be applied to prevent and control the secondary generation of hydrates in the two respective pipe columns during the exploitation of the offshore natural gas hydrate: the injection of the hydrate inhibitor will be implemented at the gas-liquid mixed transportation pipe section, the collaborative prevention and control of hydrate inhibitor injection+the heating of the pipe column bottom will be implemented at the gas recovery pipe column, and the collaborative prevention and control of depressurization by double pumps+inhibitor will be implemented at the water recovery pipe column. With the combination of the three prevention and control measures, the safe and efficient prevention and control of the secondary generation of the hydrates in the exploitation process of the offshore natural gas hydrates can be achieved to guarantee the multiphase flow safety throughout the wellbore. On one hand, the present disclosure can obviously reduce the using amount of the hydrate inhibitor. On the other hand, the present disclosure can efficiently prevent the secondary generation of the hydrates in the pilot exploitation wellbore, and the multiphase flow safety throughout the hydrate exploitation wellbore can be ensured under the combined action of multiple methods.

Figure 1:
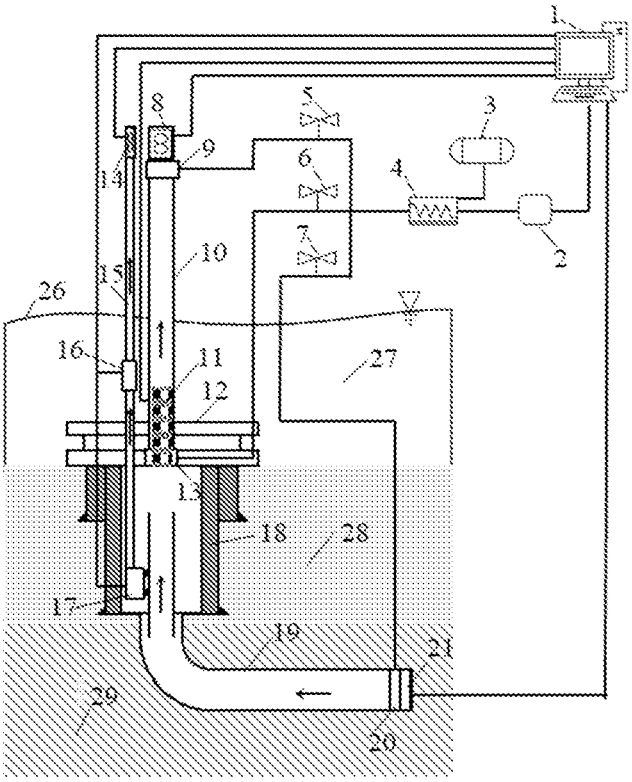
FIG. 1 is a schematic diagram of an apparatus for preventing and controlling secondary generation of hydrates during depressurization exploitation of offshore natural gas hydrates.

In the drawings, 1: computer terminal; 2: signal actuator; 3: hydrate inhibitor storage tank; 4: hydrate inhibitor injection pump; 5: control valve 1; 6: control valve 2; 7: control valve 3; 8: first data monitoring point; 9: first inhibitor injection point; 10: gas recovery pipe column; 11: heater; 12: blowout preventer; 13: second inhibitor injection point; 14: second data monitoring point; 15: water recovery pipe column; 16: second electric submersible pump module; 17: first electric submersible pump; 18: casing pipe; 19: gas-liquid mixed transportation pipe section; 20: third inhibitor injection point; 21: third data monitoring point; 22: second electric submersible pump; 23: water storage pipe section; 24: second half of water recovery pipe column; 25: first half of water recovery pipe column; 26: sea level; 27: seawater; 28: shallow seabed; and 29: hydrate reservoir.

DETAILED DESCRIPTION OF THE EMBODIMENTS

The present disclosure will be further explained with reference to embodiments and drawings, but the embodiments of the present disclosure are not limited thereto.

Embodiment 1

An apparatus for preventing and controlling secondary generation of hydrates in a wellbore during depressurization exploitation of offshore natural gas hydrates includes a gas recovery pipe column, a water recovery pipe column, a gas-liquid mixed transportation pipe section, a data collecting and processing unit, and a reaction control apparatus, and tail ends of the gas recovery pipe column and the water recovery pipe column are connected with a top of the gas-liquid mixed transportation pipe section; the gas-liquid mixed transportation pipe section is positioned in hydrate reservoirs; and the gas recovery pipe column and the water recovery pipe column recover gases and water decomposed by the natural gas hydrates in the reservoirs respectively;

the data collecting and processing unit includes a first data monitoring point, a second data monitoring point, a third data monitoring point, and a computer terminal; the first data monitoring point is positioned on a top of the gas recovery pipe column, and collects a temperature, pressure and gas flow of the top of the gas recovery pipe column; the second data monitoring point is positioned on a top of the water recovery pipe column, and collects a temperature, pressure and gas flow of the top of the water recovery pipe column; the third data monitoring point is positioned on a tail end of the gas-liquid mixed transportation pipe section, and collects a temperature and pressure of a well bottom; and the computer terminal receives and processes temperature, pressure, and flow data collected from the first data monitoring point, the second data monitoring point, and the third data monitoring point;

the reaction control apparatus includes a signal actuator, a hydrate inhibitor storage tank, a hydrate inhibitor injection pump, a first inhibitor injection point, a second inhibitor injection point, a third inhibitor injection point, a first electric submersible pump, a second electric submersible pump, and a heater; one end of the signal actuator is connected with the computer terminal, and the other end of the signal actuator is connected with the hydrate inhibitor injection pump; the hydrate inhibitor injection pump is respectively connected with the first inhibitor injection point, the second inhibitor injection point, and the third inhibitor injection point via injection pipelines, and a control valve is arranged on each of the injection pipelines; the first inhibitor injection point is positioned on the top of the gas recovery pipe column, the second inhibitor injection point is positioned at a bottom of the gas recovery pipe column, and the third inhibitor injection point is positioned on the tail end of the gas-liquid mixed transportation pipe section; the first electric submersible pump is positioned at a bottom of the water recovery pipe column, and the second electric submersible pump is positioned in the middle of the water recovery pipe column; and the heater is positioned at the bottom of the gas recovery pipe column.

According to a prevention and control method of the apparatus for preventing and controlling secondary generation of hydrates during depressurization exploitation of offshore natural gas hydrates, three data collection points are installed on the top of the gas recovery pipe column, the top of the water recovery pipe column, and the tail end of the gas-liquid mixed transportation pipe section, which collect temperature, pressure and flow data at different positions; the different data collection points are connected with the computer terminal, and the collected data is transmitted to the computer terminal in real time; the computer terminal performs analysis and processing on the data collected from the different data collection points, and sends instructions to the signal actuator to control inhibitor injection rates of different hydrate inhibitor injection points, and to control power of the heater in the gas recovery pipe column and power of the different electric submersible pumps in the water recovery pipe column to prevent and control the secondary generation of the hydrates in the gas recovery pipe column and the water recovery pipe column.

Embodiment 2

An apparatus for preventing and controlling secondary generation of hydrates in a wellbore during depressurization exploitation of offshore natural gas hydrates is different from Embodiment 1 in that a joint of the water recovery pipe column and the gas-liquid mixed transportation pipe section and a joint of the gas recovery pipe column and the gas-liquid mixed transportation pipe section are provided with a casing pipe, the first electric submersible pump is positioned in the casing pipe, and a blowout preventer is arranged on a tail end of the gas recovery pipe column.

Embodiment 3

Figure 2:
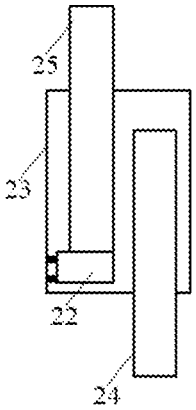
FIG. 2 is an enlarged schematic diagram of a second electric submersible pump module.

An apparatus for preventing and controlling secondary generation of hydrates in a wellbore during depressurization exploitation of offshore natural gas hydrates is different from Embodiment 1 in that a water storage pipe section is arranged in the middle of the water recovery pipe column, as shown in FIG. 2, the middle of the water recovery pipe column is divided into a first half and a second half of the water recovery pipe column, a tail end of the first half of the water recovery pipe column and a top of the second half of the water recovery pipe column are positioned in the water storage pipe section, and the second electric submersible pump is positioned on the tail end of the first half of the water recovery pipe column.

Embodiment 4

A prevention and control method of the apparatus for preventing and controlling secondary generation of hydrates in a wellbore during depressurization exploitation of offshore natural gas hydrates as described in Embodiment 1 includes the following steps:

(1) Real-Time Monitoring of Data at Different Positions temperature, pressure and flow data is monitored at different positions via the first data monitoring point on the top of the gas recovery pipe column, the second data monitoring point on the top of the water recovery pipe column, and the third data monitoring point on the tail end of the gas-liquid mixed transportation pipe section, and the collected data is transmitted to the computer terminal in real time;

(2) Analysis of Secondary Generation Risk of Hydrates Throughout Wellbore the temperature and pressure distributions throughout the wellbore are obtained by the computer terminal via calculation according to the received temperature, pressure and flow data at different positions; the computer terminal judges whether the secondary generation of the hydrates happens at different positions in combination with the phase equilibrium calculation result of the natural gas hydrates, and the secondary generation risk of the hydrates throughout the wellbore is analyzed based on the judgment result, which provides a foundation for the prevention and control of the secondary generation of the hydrates in different pipe columns;

as a significant temperature gradient exists in a stratum/seawater outside the exploitation wellbore for the offshore natural gas hydrates, a temperature difference exists between the fluid in the pipe columns and external environment. Furthermore, given differences in structures of pipe columns at different positions, distinct heat transfer processes are formed between the fluid flow in the exploitation wellbore and the external environment: ① well section below mud line-gas-liquid mixed transportation pipe section: heat transfer between the fluid in the gas-liquid mixed transportation pipe section and the external stratum; ② well section above mud line-gas recovery pipe column: heat transfer between the fluid in the gas recovery pipe column and external seawater; ③ well section above mud line-water recovery pipe column: heat transfer between the fluid in the water recovery pipe column and the external seawater; the mud line is a seabed (i.e., a boundary of the seawater and a shallow layer of the seabed); and according to characteristic of pipe columns for depressurization exploitation of offshore natural gas hydrates and in consideration of the influence of hydrate phase changes on temperature changes, the temperature distribution of the exploitation wellbore is calculated by the following formula based on the principle of conservation of energy:

$$\frac{\partial}{\partial t}\left[A_{te}\rho_m\left(C_{pm}T_f + v_m^2/2\right)\right] + \frac{\partial}{\partial s}\left[A_{te}\rho_m v_m\left(H + v_m^2/2\right)\right] = -A_{te}\rho_m v_m g\sin\theta + \frac{(R_{hf} - R_{hi})\Delta H}{M_h} + Q_{st} \tag{1}$$

where, $C_{pm}$ is a specific heat of a mixed fluid at constant pressure, J/(kg·° C.); $T_f$ is a fluid temperature, ° C.; H is a specific enthalpy of the mixed fluid, J/kg; ΔH is a molar enthalpy of formation of the hydrates, J/mol; $M_h$ is a molar molecular mass of the hydrates, kg/mol; $\rho_m$ is a density of the mixed fluid, kg/m$^3$; $v_m$ is a flow velocity of the mixed fluid, m/s; $Q_{st}$ indicates a heat exchange rate between the fluid in the pipe columns and ambient environment, J/(m·s); s is a position, m; $A_{te}$ is a net sectional area of the pipe column, m$^2$; $R_{hf}$ is a generation rate of the hydrates, kg/(m·s); $R_{hi}$ is a decomposition rate of the hydrates, kg/(m·s); and θ is an angle of inclination, °.

Due to the differences in the structures of exploitation pipe columns at different well depths, the calculation of $Q_{st}$ will vary with different well depth positions;

Well Section Above Mud Line-Gas Recovery Pipe Column:

$$Q_{st} = \frac{2r_{tgo}U_{tgo}}{v_m r_{tgi}^2}\cdot(T_{sea} - T_f) \quad H_d \le H_{sea} \tag{2}$$

Well Section Above Mud Line-Water Recovery Pipe Column:

$$Q_{st} = \frac{2r_{two}U_{two}}{v_m r_{twi}^2} \cdot (T_{sea} - T_f) \quad H_d \le H_{sea} \tag{3}$$

Well Section Below Mud Line-Gas-Liquid Mixed Transportation Pipe Section:

$$Q_{st} = \frac{2}{v_m r_{ti}^2} \cdot \frac{r_{to}U_{to}k_e}{k_e + T_D r_{to}U_{to}} \cdot (T_{ei} - T_f) \quad H_d > H_{sea} \tag{4}$$

where, $r_{tgo}$, $r_{two}$ and $r_{to}$ are outer diameters of the gas recovery pipe column, the water recovery pipe column, and the gas-liquid mixed transportation pipe section, respectively, m; $T_{sea}$ is a seawater temperature, ° C.; $U_{tgo}$, $U_{two}$, and $U_{to}$ are overall coefficients of heat transfer based on outer surfaces of the gas recovery pipe column, the water recovery pipe column, and the gas-liquid mixed transportation pipe section as reference surfaces, respectively, W/(m$^2$·K); $H_d$ is a well depth, m; $H_{sea}$ is a water depth, m; $T_{ei}$ is an environment temperature, ° C.; $r_{tgi}$, $r_{twi}$, and $r_{ti}$ are inner diameters of the gas recovery pipe column, the water recovery pipe column, and the gas-liquid mixed transportation pipe section, respectively, m; $k_e$ is a stratum heat conductivity coefficient, W/(m·K); and $T_D$ is a dimensionless temperature.

According to the present disclosure, preferably, in step (2), the fluid in the hydrate exploitation pipe column is primarily affected by forces of gravity, pressure difference, and frictional resistance during the flowing process. According to the principle of conservation of momentum and in consideration of factors, such as changes in gas volume fraction and changes in gas-water volume fraction distribution arising from gas expansion, a calculation formula of pressure field distribution in the pilot exploitation pipe column of the hydrates is as follows:

$$\frac{\partial}{\partial t}(A_{te}\rho_m v_m) + \frac{\partial}{\partial s}(A_{te}\rho_m v_m^2) + \frac{d(A_{te}P_f)}{ds} + A_{te}g\rho_m\cos\alpha + \frac{d(A_{te}Fr)}{ds} = 0 \tag{5}$$

where, $P_f$ is a fluid pressure in the pilot exploitation pipe column, Pa; $\alpha$ is an angle of inclination, rad; and Fr is a frictional pressure drop, Pa.

According to the present disclosure, preferably, in step (2), phase equilibrium temperature and pressure conditions of the natural gas hydrates are calculated by the following formula:

$$P_e = 10^6 \exp\left(\sum_{n=0}^{5} a_n (T_f + \Delta T_d)^n\right) \tag{6}$$

where, $$\begin{cases} a_0 = -1.94138504464560 \times 10^5 \\ a_1 = 3.31018213397926 \times 10^3 \\ a_2 = -2.25540264493806 \times 10^1 \\ a_3 = 7.67559117787059 \times 10^{-2} \\ a_4 = -1.30465829788791 \times 10^{-4} \\ a_5 = 8.86065316687571 \times 10^{-8} \end{cases} \tag{7}$$

where, $\Delta T_d$ is a temperature at which a decline in a hydrate equilibrium is caused by a hydrate inhibitor, K, which may be calculated by the following formula:

$$\Delta T_d = \Delta T_{d,r} \frac{\ln(1-x)}{\ln(1-x_r)} \tag{8}$$

where, $P_e$ is a phase equilibrium pressure of hydrates, Pa; x is a molar fraction of the hydrate inhibitor in a water phase, which is dimensionless; $x_r$ is a reference molar fraction of the hydrate inhibitor in the water phase, which is dimensionless; and $\Delta T_{d,r}$ is a temperature at which the decline in the hydrate equilibrium is caused under the molar fraction of the inhibitor as $x_r$, K.

Preferably, in step (2), the secondary generation risk of the hydrates in different pipe columns is determined by comparing the temperature of the pipe columns with the phase equilibrium temperature of the natural gas hydrates; a natural gas hydrate phase equilibrium temperature-pressure curve under the condition of the produced fluid component is converted into a temperature-depth curve by taking into account a temperature and pressure distribution curve of the wellbore and a hydrate phase equilibrium curve, for which coordinate conversion is performed; and when the temperature on the wellbore temperature curve at a certain depth is lower than that on the hydrate phase equilibrium curve, the fluid temperature in the wellbore at the depth satisfies the secondary generation condition of the hydrates, that is, there is the secondary generation risk of the hydrates. A discriminant formula of the secondary generation of the hydrates is as follows:

$$P_e > P_f \text{ or } T_e < T_f \tag{9}$$

where, Te is a phase equilibrium temperature of the hydrates, ° C.

Figure 3:
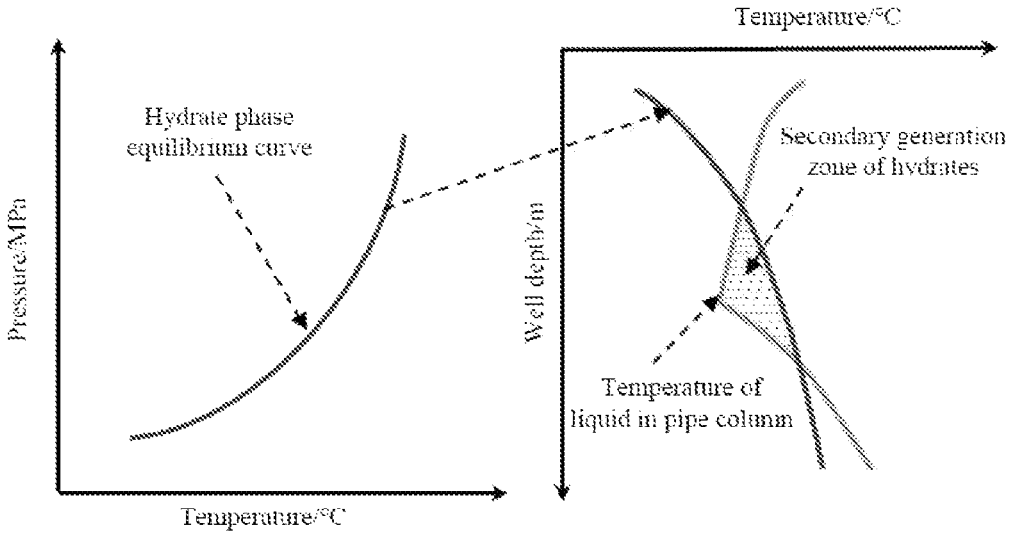
FIG. 3 is a schematic diagram of a secondary generation zone of hydrates in a wellbore.

Therefore, when the hydrate phase equilibrium curve is on the right side of the wellbore temperature curve, an area where the hydrate phase equilibrium curve intersects with the wellbore temperature curve is a secondary generation zone of the hydrates, as shown in FIG. 3. Meanwhile, the longer the length the area where the hydrate phase equilibrium curve intersects with the wellbore temperature curve is in the longitudinal direction, the more extensive the secondary generation zone of the hydrates in the exploitation wellbore will be. Additionally, the wider area in the transverse direction will result in the higher degree of supercooling of the secondary generation of the hydrates, making it easier for the secondary generation of the hydrates. Accordingly, the secondary generation risk of the hydrates in different pipe columns may be determined.

(3) Prevention and Control Reaction of Secondary Generation of Hydrates in Different Pipe Columns According to the secondary generation risk of the hydrates in different pipe columns obtained by calculation, the computer terminal sends prevention and control instructions for the secondary generation of the hydrates, and corresponding measures of preventing and controlling the secondary generation of the hydrates are taken for different pipe columns; inhibitor injection is used as the measure for preventing and controlling the secondary generation of the hydrates at the gas-liquid mixed transportation pipe section, the collaborative prevention and control of the inhibitor injection+the heating of the pipe column bottom is used as the measure for preventing and controlling the secondary generation of the hydrates in the gas recovery pipe column, and the collaborative prevention and control of depressurization by double pumps+inhibitor is used as at the measure for preventing and controlling the secondary generation of the hydrates in the water recovery pipe column. These approaches may ensure the multiphase flow safety in the exploitation wellbore for the offshore natural gas hydrates.

Different prevention and control measures for the secondary generation of the hydrates are taken for different pipe columns in the wellbore; at the gas-liquid mixed transportation pipe section, when the processing result from the computer terminal indicates that the secondary generation risk of the hydrates is found in a horizontal pipe section of the gas-liquid mixed transportation pipe section at the well bottom, the concentration of the hydrate inhibitor as required for preventing and controlling the secondary generation of the hydrates is obtained via calculation according to the prevention and control requirement for the secondary generation of the hydrates, which may be determined according to formulas (6), (7) and (8); the higher the concentration of the hydrate inhibitor, the higher the temperature and the lower the pressure at which a hydrate phase equilibrium is achieved are perceived to be; the concentration of the inhibitor is designed to make the temperature of the hydrate phase equilibrium higher than a fluid temperature or make the pressure thereof lower than a fluid pressure, thereby avoiding the secondary generation of the hydrates in the wellbore; as an injection rate is associated with the concentration, the inhibitor injection rate is obtained by multiplying the amount of recovered water by the concentration; and then, the inhibitor injection instructions are sent to the third inhibitor injection point on the tail end of the horizontal pipe section, and the control valve on the injection pipeline is opened, thereby effectively preventing and controlling the secondary generation of the hydrates in the gas-liquid mixed transportation pipe section;

for the water recovery pipe column, when the processing result from the computer terminal indicates that there is the secondary generation risk of the hydrates in the water recovery pipe column, it is required to take into account the concentration of the hydrate inhibitor which has possibly been present in an aqueous solution, and the concentration of the hydrate inhibitor in the water recovery pipe column is the same as that of the hydrate inhibitor at the gas-liquid mixed transportation pipe section; water in the water recovery pipe column is pumped from the gas-liquid mixed transportation pipe section; if the hydrate inhibitor is not injected into the third inhibitor injection point, the concentration of the existing hydrate inhibitor in the water recovery pipe column is 0; if the hydrate inhibitor is injected into the third inhibitor injection point, the concentration of the existing hydrate inhibitor in the water recovery pipe column is the concentration of the hydrate inhibitor at the gas-liquid mixed transportation pipe section; if the hydrate inhibitor is not injected into the third inhibitor injection point, the computer terminal controls, based on the processing result, the operating power of the first electric submersible pump and the operating power of the second electric submersible pump on the water recovery pipe column to reduce the pressure throughout the water recovery pipe column until the pressure in the pipe column drops to below the pressure of the hydrate phase equilibrium, thereby preventing and controlling the secondary generation of the hydrates therein. Meanwhile, the output power of the first electric submersible pump and the output power of the second electric submersible pump are maintained at a consistent level, which ensures that the liquid level in the second electric submersible pump module stays above the second electric submersible pump (the whole water recovery pipe column is filled with water, and the liquid level refers to a liquid level of the water storage pipe section, as shown in FIG. 2, which is simply positioned above the second electric submersible pump to avoid the idling of the electric submersible pump), thus maintaining the flow safety of the fluid in the water recovery pipe column; if the pressure in the water recovery pipe column is unable to drop below the hydrate phase equilibrium pressure, the hydrate inhibitor needs to be injected into the third inhibitor injection point; once the hydrate inhibitor has been injected into the third inhibitor injection point, the inhibitor concentration in the water recovery pipe column remains consistent with that at the gas-liquid mixed transportation pipe section; in this case, to reduce the pressure throughout the water recovery pipe column, the operating power of the first electric submersible pump and the operating power of the second electric submersible pump on the column are regulated, allowing the pressure in the pipe columns to drop below the hydrate phase equilibrium pressure; and meanwhile, the output power of the first electric submersible pump and the output power of the second electric submersible pump are maintained at a consistent level, which ensures that the liquid level in the second electric submersible pump module stays above the second electric submersible pump. If depressurization by the electric submersible pumps and the existing inhibitor concentration may not meet the prevention and control requirement of the hydrates, it is critical to continue injecting a certain concentration of hydrate inhibitor into the third inhibitor injection point additionally to avoid the generation of the hydrates; and if the inhibitor is not injected into the bottom (the third inhibitor injection point) of the gas-liquid mixed transportation pipe section, the concentration of the inhibitor in the water recovery pipe column is zero, as a result, if the prevention and control requirement of the hydrates may be met only by the depressurization by the electric submersible pumps, it is unnecessary to inject the hydrate inhibitor from the third inhibitor injection point, or else, it is critical to additionally inject a certain concentration of hydrate inhibitor into the third inhibitor injection point to avoid the generation of the hydrates; and if the inhibitor is injected into the bottom (the third inhibitor injection point) of the gas-liquid mixed transportation pipe section, the concentration of the inhibitor in the water recovery pipe column is consistent with that of the inhibitor at the gas-liquid mixed transportation pipe section. In this case, if the depressurization by the electric submersible pumps and the existing inhibitor concentration may meet the prevention and control requirement of the hydrates, it is unnecessary to inject the hydrate inhibitor into the third inhibitor injection point, or else, it is imperative to continue injecting a certain concentration of hydrate inhibitor into the third inhibitor injection point additionally to avoid the generation of the hydrates. The existing inhibitor concentration requires less depressurization as the inhibitor present in water maintains the higher pressure required for producing the hydrates. This makes the hydrates more difficult to generate.

For the gas recovery pipe column, when the processing result from the computer terminal indicates that there is the secondary generation risk of the hydrates in the gas recovery pipe column, the computer terminal sends the heating instructions to the heater at the bottom of the gas recovery pipe column to elevate gas temperature in the gas recovery pipe column, and after heating, the concentration of the hydrate inhibitor required for preventing and controlling the secondary generation of the hydrates is calculated according to the prevention and control requirement for the secondary generation of the hydrates, and the secondary generation of the hydrates is determined according to formulas (6), (7) and (8); the inhibitor injection instructions are sent to the first inhibitor injection point and the second inhibitor injection point, and the control valve on the injection pipeline is opened; the injection flow rate of the first inhibitor injection point is independent of that of the second inhibitor injection point; the latter is used specifically to prevent the secondary generation of the hydrates in the gas recovery pipe column. The former, however, is used to stabilize the concentration of the inhibitor and avoid the generation risk of the hydrates arising from throttling and temperature drops of the produced fluid that flows into the platform pipeline; and a heating temperature is encouraged to be at the highest level possible, but an ideal state of being above the phase equilibrium temperature of the hydrates after heating is impossible to achieve for the heating apparatus on site. As such, the secondary generation risk of the hydrates is prevented in the gas recovery pipe column by combining heating and inhibitor injection, that is, heating is performed, and then, the concentration of the injected inhibitor and the injection rate are determined based on the temperature after heating, thereby achieving the prevention and control of the secondary generation risk of the hydrates in the gas recovery pipe column.

What is claimed is:

1. An apparatus for preventing and controlling secondary generation of hydrates in a wellbore during depressurization exploitation of offshore natural gas hydrates, wherein the apparatus comprises a gas recovery pipe column, a water recovery pipe column, a gas-liquid mixed transportation pipe section, a data collecting and processing unit, and a reaction control apparatus; tail ends of the gas recovery pipe column and the water recovery pipe column are connected with a top of the gas-liquid mixed transportation pipe section; the gas-liquid mixed transportation pipe section is positioned in hydrate reservoirs; and the gas recovery pipe column and the water recovery pipe column recover gases and water decomposed by the natural gas hydrates in the reservoirs respectively, a joint of the water recovery pipe column and the gas-liquid mixed transportation pipe section and a joint of the gas recovery pipe column and the gas-liquid mixed transportation pipe section are provided with a casing pipe, the first electric submersible pump is positioned in the casing pipe, and a blowout preventer is arranged on a tail end of the gas recovery pipe column;

the data collecting and processing unit comprises a first data monitoring point, a second data monitoring point, a third data monitoring point, and a computer terminal; the first data monitoring point is positioned on a top of the gas recovery pipe column, and collects a temperature, pressure and gas flow of the top of the gas recovery pipe column; the second data monitoring point is positioned on a top of the water recovery pipe column, and collects a temperature, pressure and gas flow of the top of the water recovery pipe column; the third data monitoring point is positioned on a tail end of the gas-liquid mixed transportation pipe section, and collects a temperature and pressure of a well bottom; and the computer terminal receives and processes temperature, pressure, and flow data collected from the first data monitoring point, the second data monitoring point, and the third data monitoring point;

the reaction control apparatus comprises a signal actuator, a hydrate inhibitor storage tank, a hydrate inhibitor injection pump, a first inhibitor injection point, a second inhibitor injection point, a third inhibitor injection point, a first electric submersible pump, a second electric submersible pump, and a heater; one end of the signal actuator is connected with the computer terminal, and the other end of the signal actuator is connected with the hydrate inhibitor injection pump; the hydrate inhibitor injection pump is respectively connected with the first inhibitor injection point, the second inhibitor injection point, and the third inhibitor injection point via injection pipelines, and a control valve is arranged on each of the injection pipelines; the first inhibitor injection point is positioned on the top of the gas recovery pipe column, the second inhibitor injection point is positioned at a bottom of the gas recovery pipe column, and the third inhibitor injection point is positioned on the tail end of the gas-liquid mixed transportation pipe section; the first electric submersible pump is positioned at a bottom of the water recovery pipe column, and the second electric submersible pump is positioned in the middle of the water recovery pipe column; and the heater is positioned at the bottom of the gas recovery pipe column; and the apparatus collecting, by the three data collection points installed on the top of the gas recovery pipe column, the top of the water recovery pipe column, and the tail end of the gas-liquid mixed transportation pipe section, temperature, pressure and flow data at different positions, the different data collection points being connected with the computer terminal for transmitting the collected data to the computer terminal in real time; performing, by the computer terminal, analysis and processing on the data collected from the different data collection points, sending instructions to the signal actuator to control inhibitor injection rates of different hydrate inhibitor injection points, and to control power of the heater in the gas recovery pipe column and power of the different electric submersible pumps in the water recovery pipe column to prevent and control the secondary generation of the hydrates in the gas recovery pipe column and the water recovery pipe column.

2. The apparatus for preventing and controlling secondary generation of hydrates in a wellbore during depressurization exploitation of offshore natural gas hydrates according to claim 1, wherein a water storage pipe section is arranged in the middle of the water recovery pipe column, the middle of the water recovery pipe column is divided into a first half and a second half of the water recovery pipe column, a tail end of the first half of the water recovery pipe column and a top of the second half of the water recovery pipe column are positioned in the water storage pipe section, and the second electric submersible pump is positioned on the tail end of the first half of the water recovery pipe column.

3. The apparatus for preventing and controlling secondary generation of hydrates in a wellbore during depressurization exploitation of offshore natural gas hydrates according to claim 1, wherein the apparatus performing (i) real-time monitoring of data at different positions monitoring temperature, pressure and flow data at different positions via the first data monitoring point on the top of the gas recovery pipe column, the second data monitoring point on the top of the water recovery pipe column, and the third data monitoring point on the tail end of the gas-liquid mixed transportation pipe section, and transmitting the collected data to the computer terminal in real time;

(ii) analysis of a secondary generation risk of hydrates throughout wellbore performing real-time calculation in real time by the computer terminal according to the temperature, pressure and flow data received thereby at different positions to obtain temperature and pressure distributions throughout the wellbore; judging, by combining a phase equilibrium calculation result of the natural gas hydrates, whether the secondary generation of the hydrates happens at different positions, and determining the secondary generation risk of the hydrates throughout the wellbore; and (iii) prevention and control reaction of secondary generation of hydrates in different pipe columns sending, by the computer terminal, prevention and control instructions of the secondary generation of the hydrates according to the secondary generation risk of the hydrates in different pipe columns obtained by calculation, and taking corresponding measures for preventing and controlling the secondary generation of the hydrates for different pipe columns, wherein inhibitor injection is used as the measure for preventing and controlling the secondary generation of the hydrates at the gas-liquid mixed transportation pipe section, the collaborative prevention and control of the inhibitor injection+the heating of the pipe column bottom is used as the measure for preventing and controlling the secondary generation of the hydrates in the gas recovery pipe column, and the collaborative prevention and control of depressurization by double pumps+inhibitor is used as at the measure for preventing and controlling the secondary generation of the hydrates in the water recovery pipe column.

4. The apparatus for preventing and controlling secondary generation of hydrates in a wellbore during depressurization exploitation of offshore natural gas hydrates according to claim 3, wherein in step (ii), distinct heat transfer processes are set between a fluid flow in the exploitation wellbore and an external environment: (1) well section below mud line-gas-liquid mixed transportation pipe section: heat transfer between a fluid in the gas-liquid mixed transportation pipe section and an external stratum; (2) well section above mud line-gas recovery pipe column: heat transfer between the fluid in the gas recovery pipe column and external seawater; (3) well section above mud line-water recovery pipe column: heat transfer between the fluid in the water recovery pipe column and the external seawater; the mud line is a boundary of the seawater and a shallow layer of a seabed; and the temperature distribution of the exploitation wellbore is calculated by the following formula:

$$\frac{\partial}{\partial t}\left[A_{te}\rho_m\left(C_{pm}T_f + v_m^2/2\right)\right] + \frac{\partial}{\partial s}\left[A_{te}\rho_m v_m\left(H + v_m^2/2\right)\right] = -A_{te}\rho_m v_m g\sin\theta + \frac{(R_{hf} - R_{hi})\Delta H}{M_h} + Q_{st} \quad (1)$$

where, $C_{pm}$ is a specific heat of a mixed fluid at constant pressure, J/(kg·° C.); $T_f$ is a fluid temperature, ° C.; H is a specific enthalpy of the mixed fluid, J/kg; ΔH is a molar enthalpy of formation of the hydrates, J/mol; $M_h$ is a molar molecular mass of the hydrates, kg/mol; $\rho_m$ is a density of the mixed fluid, kg/m$^3$; $v_m$ is a flow velocity of the mixed fluid, m/s; $Q_{st}$ indicates a heat exchange rate between the fluid in the pipe columns and ambient environment, J/(m·s); s is a position, m; $A_{te}$ is a net sectional area of the pipe column, m$^2$; $R_{hf}$ is a generation rate of the hydrates, kg/(m·s); $R_{hi}$ is a decomposition rate of the hydrates, kg/(m·s); and θ is an angle of inclination, °;

due to the difference of structures of the exploitation pipe columns at different well depths, the calculation of $Q_{st}$ will vary with different well depth positions;

well section above mud line-gas recovery pipe column:

$$Q_{st} = \frac{2r_{tgo}U_{tgo}}{v_m r_{tgi}^2}\cdot(T_{sea} - T_f) \quad H_d \le H_{sea} \quad (2)$$

well section above mud line-water recovery pipe column:

$$Q_{st} = \frac{2r_{two}U_{two}}{v_m r_{twi}^2}\cdot(T_{sea} - T_f) \quad H_d \le H_{sea} \quad (3)$$

well section below mud line-gas-liquid mixed transportation pipe section:

$$Q_{st} = \frac{2}{v_m r_{ti}^2}\cdot\frac{r_{to}U_{to}k_e}{k_e + T_D r_{to}U_{to}}\cdot(T_{ei} - T_f) \quad H_d > H_{sea} \quad (4)$$

where, $r_{tgo}$, $r_{two}$, and $r_{to}$ are outer diameters of the gas recovery pipe column, the water recovery pipe column, and the gas-liquid mixed transportation pipe section, respectively, m; $T_{sea}$ is a seawater temperature, ° C.; $U_{tgo}$, $U_{two}$, and $U_{to}$ are overall coefficients of heat transfer based on outer surfaces of the gas recovery pipe column, the water recovery pipe column, and the gas-liquid mixed transportation pipe section as reference surfaces, respectively, W/(m$^2$·K); $H_d$ is a well depth, m; $H_{sea}$ is a water depth, m; $T_{ei}$ is an environment temperature, ° C.; $r_{tgi}$, $r_{twi}$, and $r_{ti}$ are inner diameters of the gas recovery pipe column, the water recovery pipe column, and the gas-liquid mixed transportation pipe section, respectively, m; $k_e$ is a stratum heat conductivity coefficient, W/(m·K); and $T_D$ is a dimensionless temperature.

5. The apparatus for preventing and controlling secondary generation of hydrates in a wellbore during depressurization exploitation of offshore natural gas hydrates according to claim 4, wherein in step (2), a pressure field distribution in the hydrate pilot exploitation pipe column is calculated by the following formula:

$$\frac{\partial}{\partial t}(A_{te}\rho_m v_m) + \frac{\partial}{\partial s}\left(A_{te}\rho_m v_m^2\right) + \frac{d(A_{te}P_f)}{ds} + A_{te}g\rho_m\cos\alpha + \frac{d(A_{te}Fr)}{ds} = 0 \quad (5)$$

where, $P_f$ is a fluid pressure in the pilot exploitation pipe column, Pa; α is an angle of inclination, rad; and Fr is a frictional pressure drop, Pa.

6. The apparatus for preventing and controlling secondary generation of hydrates in a wellbore during depressurization exploitation of offshore natural gas hydrates according to claim 5, wherein in step (ii), phase equilibrium temperature and pressure conditions of the natural gas hydrates are calculated by the following formula:

$$P_e = 10^6\exp\left(\sum_{n=0}^{5} a_n(T_f + \Delta T_d)^n\right) \quad (6)$$

-continued where, $$\begin{cases} a_0 = -1.94138504464560 \times 10^5 \\ a_1 = 3.31018213397926 \times 10^3 \\ a_2 = -2.25540264493806 \times 10^1 \\ a_3 = 7.67559117787059 \times 10^{-2} \\ a_4 = -1.30465829788791 \times 10^{-4} \\ a_5 = 8.86065316687571 \times 10^{-8} \end{cases} \quad (7)$$

where, $\Delta T_d$ is a temperature at which a decline in a hydrate equilibrium is caused by a hydrate inhibitor, K, which may be calculated by the following formula:

$$\Delta T_d = \Delta T_{d,r} \frac{\ln(1-x)}{\ln(1-x_r)} \quad (8)$$

where, $P_e$ is a phase equilibrium pressure of hydrates, Pa; x is a molar fraction of the hydrate inhibitor in a water phase, which is dimensionless; $x_r$ is a reference molar fraction of the hydrate inhibitor in the water phase, which is dimensionless; and $\Delta T_{d,r}$ is a temperature at which the decline in the hydrate equilibrium is caused under the molar fraction of the inhibitor as $x_r$, K.

7. The apparatus for preventing and controlling secondary generation of hydrates in a wellbore during depressurization exploitation of offshore natural gas hydrates according to claim 6, wherein in step (ii), the secondary generation risk of the hydrates in different pipe columns is determined by comparing a phase equilibrium temperature of the pipe columns with a temperature of the natural gas hydrates; a natural gas hydrate phase equilibrium-pressure curve under the condition of the produced fluid component is converted into a temperature-depth curve by taking into account a temperature and pressure distribution curve of the wellbore and a hydrate phase equilibrium curve, for which coordinate conversion is performed; and when the temperature on the wellbore temperature curve at a certain depth is lower than that on the hydrate phase equilibrium curve, a fluid temperature in the wellbore at the depth satisfies the secondary generation condition of the hydrates, that is, there is the secondary generation risk of the hydrates, a discriminant formula of the secondary generation of the hydrates is as follows:

$$P_e > P_f \text{ or } T_e < T_f \quad (9)$$

where, Te is a phase equilibrium temperature of the hydrates, ° C.

8. The apparatus for preventing and controlling secondary generation of hydrates in a wellbore during depressurization exploitation of offshore natural gas hydrates according to claim 7, wherein in step (iii), different prevention and control measures of the secondary generation of the hydrates are taken for different pipe columns in the wellbore; at the gas-liquid mixed transportation pipe section, when the processing result from the computer terminal indicates that the secondary generation risk of the hydrates is found in a horizontal pipe section of the gas-liquid mixed transportation pipe section at the well bottom, the concentration of a hydrate inhibitor as required for preventing and controlling the secondary generation of the hydrates is obtained via calculation according to the prevention and control requirement for the secondary generation of the hydrates, which may be determined according to formulas (6), (7) and (8); the higher the concentration of the hydrate inhibitor, the higher the temperature and the lower the pressure at which a hydrate phase equilibrium is achieved are perceived to be; the concentration of the inhibitor is designed to make the phase equilibrium temperature of the hydrates higher than a fluid temperature or make the phase equilibrium pressure thereof lower than a fluid pressure; an inhibitor injection rate is obtained by multiplying the amount of recovered water by the concentration; and then, the inhibitor injection instructions are sent to the third inhibitor injection point on the tail end of the horizontal pipe section, and the control valve on the injection pipeline is opened;

for the water recovery pipe column, when the processing result from the computer terminal indicates that there is the secondary generation risk of the hydrates in the water recovery pipe column, the concentration of the hydrate inhibitor which has possibly been present in an aqueous solution needs to be considered, and the concentration of the hydrate inhibitor in the water recovery pipe column is the same as that of the hydrate inhibitor at the gas-liquid mixed transportation pipe section; if the hydrate inhibitor is not injected into the third inhibitor injection point, the concentration of the existing hydrate inhibitor in the water recovery pipe column is 0; if the hydrate inhibitor is injected into the third inhibitor injection point, the concentration of the existing hydrate inhibitor in the water recovery pipe column is the concentration of the hydrate inhibitor at the gas-liquid mixed transportation pipe section; if the hydrate inhibitor is not injected into the third inhibitor injection point, the computer terminal controls, based on the processing result, the operating power of the first electric submersible pump and the operating power of the second electric submersible pump on the water recovery pipe column to reduce the pressure throughout the water recovery pipe column until the pressure in the pipe column drops to below the pressure of the hydrate phase equilibrium, and the output power of the first electric submersible pump and the output power of the second electric submersible pump are maintained at a consistent level, which ensures that a liquid level in a second electric submersible pump module stays above the second electric submersible pump; if a pressure of the water recovery pipe column is unable to drop to below the hydrate phase equilibrium pressure, the hydrate inhibitor needs to be injected into the third inhibitor injection point; if the hydrate inhibitor is injected into the third inhibitor injection point, the operating power of the first electric submersible pump and the operating power of the second electric submersible pump on the water recovery pipe column are controlled to reduce the pressure throughout the water recovery pipe column until the pressure in the pipe column drops to below the hydrate phase equilibrium pressure, and the output power of the first electric submersible pump and the output power of the second electric submersible pump are maintained at a consistent level, which ensures that the liquid level in the second electric submersible pump module stays above the second electric submersible pump; and if depressurization by the electric submersible pumps and the existing inhibitor concentration may not meet the prevention and control requirement of the hydrates, the hydrate inhibitor continues to be injected into the third inhibitor injection point additionally; and for the gas recovery pipe column, when the processing result from the computer terminal indicates that there is the secondary generation risk of the hydrates in the gas recovery pipe column, heating instructions are sent to a heater at the bottom of the gas recovery pipe column to elevate gas temperature in the gas recovery pipe column, and after heating, the concentration of the hydrate inhibitor required for preventing and controlling the secondary generation of the hydrates is calculated according to the prevention and control requirement for the secondary generation of the hydrates, and the secondary generation of the hydrates is determined according to formulas (6), (7) and (8); and inhibitor injection instructions are sent to the first inhibitor injection point and the second inhibitor injection point, and the control valve on the injection pipeline is opened.

* * * * *